United States Patent [19]

Cottrell

[11] 4,195,746

[45] Apr. 1, 1980

[54] FOOD CONTAINER

[76] Inventor: Douglas J. Cottrell, 195 Langley Ave., Toronto, Ontario, Canada, M4K 1B8

[21] Appl. No.: 965,269

[22] Filed: Dec. 1, 1978

Related U.S. Application Data

[63] Continuation of Ser. No. 840,745, Oct. 11, 1977, abandoned.

[51] Int. Cl.[2] ..... A45C 11/20; B65D 1/24

[52] U.S. Cl. ..... 220/4 E; 206/545; 220/902; 220/72

[58] Field of Search ..... 220/4 B, 4 E, 9 F; 229/2.5; 220/72; 206/545

[56] References Cited

U.S. PATENT DOCUMENTS

| | | | |
|---|---|---|---|
| 3,251,460 | 4/1966 | Edmonds | 220/4 E |
| 3,484,015 | 12/1969 | Rowan | 220/4 E |
| 3,613,933 | 10/1971 | Pilz | 220/4 B |
| 3,754,640 | 8/1973 | Bridges | 220/23.6 |
| 3,830,363 | 8/1974 | Liber | 220/4 B |
| 3,835,281 | 9/1974 | Mannix | 220/22 |
| 3,908,852 | 9/1975 | Ricobone | 220/4 E |
| 4,058,217 | 11/1977 | Mancuso | 220/4 B |

*Primary Examiner*—George E. Lowrance
*Attorney, Agent, or Firm*—Sim & McBurney

[57] ABSTRACT

A novel food container for the storage and transport of food, particularly hot food such as pizza. The container comprises an identical upper and lower portion, each portion having a flat, base surface, outwardly extending side walls with a circumferential lip therearound. A locking means is carried on the lip to releasably lock the upper and lower portions together. A plurality of vertical honeycombs are on the interior of the base surface and a plurality of buttresses are found in the interior side walls. The device is preferably made of an expanded material such as polystyrene and only requires an single mould to manufacture it.

7 Claims, 4 Drawing Figures

FOOD CONTAINER

This is a continuation application Ser. No. 840,745, filed Oct. 11, 1977, now abandoned.

BACKGROUND OF THE INVENTION

1. Field of the Invention

This invention relates generally to containers and more particularly to a novel container suitable for storing and transporting hot food. It has particular suitability as a pizza container.

2. Description of the Prior Art

In the past, hot food was stored and transported in ordinary cardboard boxes. Needless to say, these containers presented many problems. When hot food was placed in these containers, a rapid and large heat loss occurred and as well, if the food was to any degree fluid or liquid, this liquid would run off the food when the container was being transported and cause the container to be soggy or even fall apart. When the food was delivered to its ultimate destination, it would arrive cold and in some instances, in a broken container.

More recently, containers have been constructed of different designs in an attempt to overcome these problems. Also, different materials have been utilized in the construction of the containers in an attempt to overcome the problems of breakage of the container.

The prior art has attempted to overcome the following basic problems:

1. insulating the food within the container;
2. deterioration of the container due to leakage from the food;
3. necessity of different moulds for the cover and the base of the container;
4. maintaining the necessary rigidity of construction;
5. preventing condensation inside the container and subsequent absorption of moisture by the food;
6. high cost of manufacture;
7. space necessary for storage of the containers.

The devices of the prior art have successfully overcome some of the aforenoted problems but no device has been able to overcome all of the aforenoted problems.

The insulating food container described in U.S. Pat. No. 3,484,015 issued to Rowan describes an insulated food container manufactured from pressed polystyrene beads which utilize an upper portion sealed to a bottom portion. However, the device of Rowan does not provide adequate circulation of air within the container to prevent the contents thereof from becoming soggy nor does this device have sufficient support to withstand the abuse suffered by containers when used, for example, for deliveries of such foods as pizza.

Examples of other devices disclosed are seen in U.S. Pat. Nos. 3,613,933 issued to Pilz on Oct. 19, 1971; 3,754,640 issued to Bridges on Aug. 28, 1973 and 3,835,281 issued to Mannix on Sept. 10, 1974. However, none of these devices disclose a construction which allows adequate circulation of air, strength of construction and efficiency of manufacture and low cost as provided by the device of the present invention.

SUMMARY OF THE INVENTION

Accordingly, it is an object of the present invention to at least partially overcome these disadvantages by providing a novel container for the storage and transport of food which comprises identical upper and lower sections which may be releasably secured to each other. The inner surface of the sections include a honeycomb configuration and support buttresses are provided on the interior surface of each side wall to increase the strength of the container.

To this end, in one of its aspects, the invention provides an insulated food container for the storage and transport of food comprising:

(a) an upper and lower portion, said upper and said lower portions being identical, each said portion comprising:
  (i) a flat base surface
  (ii) outwardly extending side walls, and
  (iii) a circumferential lip around the top of said side walls;
(b) a locking means adapted to releasably lock said upper and said lower portions together,
(c) a plurality of vertical honeycombs on the interior surface of said base surface,
(c) a plurality of buttresses on the interior of each sid wall.

In another of its aspects, the invention provides a polystyrene insulated food container for the storage and transport of food comprising:

(a) an upper and lower portion, said upper and said lower portions being identical, each portion comprising:
  (i) a flat base surface
  (ii) outwardly extending side walls, and
  (iii) a circumferential lip around the top of said side walls;
(b) a locking means adapted to releasably lock said upper and said lower portions together, said locking means comprising a protrusion extending upwardly from the top surface of said lip about one-half the circumference of said lip and a complementary recessed portion in the remaining one-half portion of the circumference of said lip;
(c) a plurality of vertical honeycombs on the interior surface of said base surface, and
(d) a plurality of buttresses on the interior of each side wall, each buttress extending the height of the side wall and the base of each buttress being adjacent each honeycomb adjacent the side wall.

BRIEF DESCRIPTION OF THE DRAWINGS

Further objects and advantages of the invention will appear from the following description taken together with the accompanying drawings in which.

DESCRIPTION OF THE PREFERRED EMBODIMENT

Figure 1:
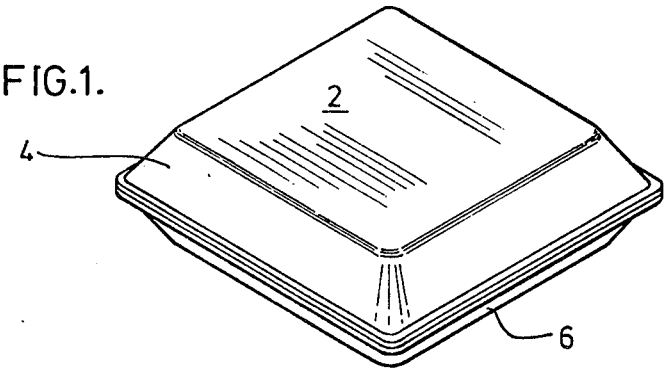
FIG. 1 is a front perspective view of a container of the present invention.

Referring first to FIG. 1, there is shown and disclosed a perspective view of the novel food container of the present invention generally indicated as 2 when in the assembled position ready for use. The container, when assembled, comprises an upper portion 4 and a lower portion 6.

Figure 2:
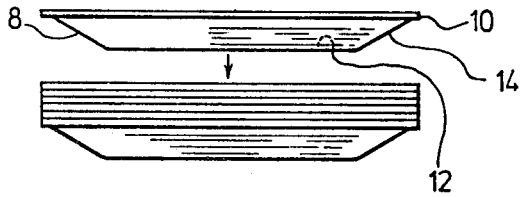
FIG. 2 is a side view of a stack of the component parts of the present invention.

The two portions are identical and as shown in FIG. 2, each comprises a base 8 which is comprised of a flat surface 12 and side walls 14, and a circumferential lip 10 on the upper edge of the side walls 14. Each portion resembles a shallow tray and is open at the top surface. When assembled as shown in FIG. 1, the circumferential lip on two parts are placed in contact with each other (as explained hereinafter) thereby achieved a completely closed container 2 as shown in FIG. 1. Since each portion is identical to the other portion, a series of these parts may be conveniently stacked as shown in FIG. 2 of the drawings. This reduces considerably the space required to store the parts of the containers prior to their use.

Figure 3:
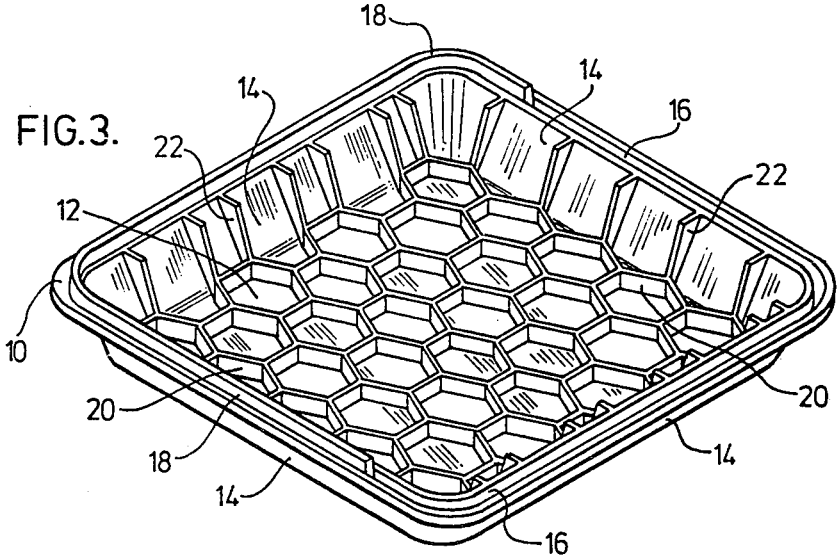
FIG. 3 is a top perspective view of a bottom unit of the container.

Referring now to FIG. 3, there is shown a top perspective view of one portion of the container 2.

Each portion comprises a flat, bottom surface 12 with outwardly sloping walls 14 which terminate in a circumferential lip 10. Lip 10 extends completely about the periphery of the container 2 and carries on it, a releasable locking means adapted to releasably lock two parts together. An example of a suitable locking means is shown in FIG. 3 and includes a continuous recessed rectangular slot or groove 16 in one-half of the circumference of the lip and for the remaining one-half portion, a continuous, upwardly projecting protrusion or tongue 18 is dispersed.

Figure 4:
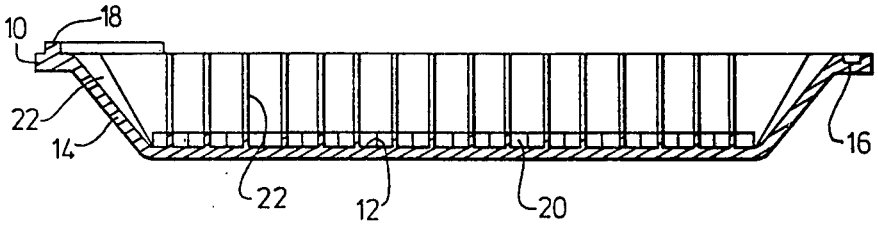
FIG. 4 is a side sectional view through the side wall of a unit.

The bottom wall 12 of the container carries thereon, a series of honeycomb raised portions 20 which are included for both strength and circulation purposes. A series of buttresses 22 are located flush on the inner surface of the walls 14 and correspond in the preferred embodiment, to the area of the honeycomb in proximity to the wall 14. A side sectional view through a side wall 14 is seen in FIG. 4.

The device of the present invention effectively overcomes the problems associated with the prior art in a novel and unique manner.

It is necessary to maintain the heat within the container to provide an effective seal about the container. The need for this seal must of course be balanced by a relatively simple and inexpensive seal to justify the use thereof in view of the cost of manufacturing the container.

The present invention achieves this effective seal by providing the protrusion or tongue 18 about one-half the periphery of the lip 10 and the recessed portion 16 or groove about the remaining one-half portion of the lip 10. The tongue is adapted to be fitted into the groove when the container is assembled to releasably secure the top portion 4 to the bottom portion 6 of the container. The tongue 18 and the groove 16 are each, about exactly one-half the periphery of the lip 10. Thus, when the two portions of the container are placed, one above the other, the top inverted and secured to the bottom, the tongue 18 fits exactly within the recessed portion or groove 16. Thus, an exacting match is achieved and a 100% seal is formed.

Different variations of this tongue and groove design may be used and still fall within the scope and spirit of this invention. For example, the locking or sealing device may include a double tongue construction with a corresponding double groove receptacle.

The bottom surface 12 of the device carries thereof a honeycomb for strengthening purposes and also to retain heat in the container. The size of the honeycomb may vary but preferably, is approximately one-quarter inch high with a chamber diameter of three-eights of an inch and a wall thickness of one-eighth of an inch for a container having a diameter of fourteen inches.

The design of the honeycombs within the container and the sealing of the upper and the lower portions of the container together effectively prevent condensation within the container when hot food is placed therein. As noted before, one of the problems associated with the devices of the prior art has been the condensation of moisture within the filled container and subsequent absorption of this moisture by the food product inside thereby resulting in the deterioration and spoilage of the food.

In order to prevent this condensation, there must be sufficient air flow within the container but no air flow to the outside. The internal air flow must be such to circulate around the contents of the container but not be allowed to exit from the container and an air flow into the container must be prevented. The depth of the honeycombs in the device of the present invention allows for such internal air flow and the sealing of the top and bottom portions prevents any air flow into or out of the container. Thus, condensation of moisture onto the enclosed food is effectively prevented while maintaining the temperature of the food inside the container.

The container of the present invention may be manufactured of a suitable, lightweight and inexpensive plastic material. While not restricted thereto, a particular suitable material is polystyrene. Expanded foams with high insulating properties are preferred rather than compressed materials.

The strength of the present device is increased remarkably over the devices of the prior art. It is known that one of the major problems with lightweight plastic devices is that these containers cannot withstand a large internal weight and also, cannot withstand a large compressive external force applied thereto. It is therefore essential to manufacture a device which will be able to withstand both external and internal forces. The combination of the honeycombs 20 and the buttresses 22 effectively overcome this problem.

A large internal weight or force may be sustained by the honeycomb design and in combination with the buttresses 22 on the side walls, the device is able to withstand large externally applied compression. Thus, a larger container may be constructed than those of the prior art and these larger containers withstand rough handling and treatment without suffering any damage.

The construction and design of the containers of the present invention also allow, if desired, a square or rectangular container to be constructed. In the past, when a larger container was required, it was manufactured in a round shape thus resulting in considerable wastage of materials and increased cost.

If desired, a separate latching or locking device may be used with the container. The present disclosure refers to a tongue and groove mechanism but it is understood that similar locking mechanisms may also be used such as complementary rivetting systems.

A particular advantage of the device of the present invention is that only one mould is necessary during the manufacturing thereof. The top and bottom portions of the container are identical thus reducing the cost of production. Also, the problems of storage of these containers has been reduced. Since the top and bottom of each container is identical and of the same shape as noted hereinbefore, they may be stacked in a single pile thereby helping to reduce the amount of space required for storage of the containers.

The device of the present invention has successfully overcome many of the problems of the prior art. The container effectively maintains the temperature of the food contained therein and by its construction, will not deteriorate if it becomes wet. The top and bottom portions are identical and thus, only one mould is necessary to manufacture all the parts of the container. The container is remarkably strong due to the honeycombs and the buttresses and condensation is prevented within the container eliminating the spoilage of the food within the container. The cost of production is much lower than previous containers and as noted before, it may be stacked quite conveniently thereby reducing storage space required.

Although the disclosure describes and illustrates a preferred embodiment of the invention, it is to be understood the invention is not restricted to this particular embodiment.

I claim:

1. An insulated, hermetically-sealable, thin-walled food container for the storage and transport of food, comprising:

(a) an upper portion and a lower portion, said upper and said lower portions being identical, each said portion comprising:
(i) a thin-walled flat base surface,
(ii) thin, outwardly-extending side walls, and
(iii) a circumferential lip around the top of said side walls;

(b) locking means adapted to releasably and hermetically lock said upper and lower portions together, (c) a plurality of elongate wall members integral with and upstanding from the interior surface of said base surface, each of said plurality of wall members being integrally joined at each end thereof to two others of said wall members to define a regular pattern of hexagonally-shaped recesses upstanding from said base surface, except for said wall members immediately adjacent said side wall which are joined to each other at each end and from the outer perimeter of said regular pattern of recesses, and (d) a plurality of vertical elongate parallel ribs integral with and extending from the interior of each side wall to impart strength thereto, said ribs extending downwardly into integral join with the integrally-joined ends of said perimeter-forming wall members adjacent said side walls.

2. An insulated food container as claimed in claim 1 wherein said locking means comprises a protrusion extending upwardly from the top surface of said lip about one-half of the circumference of said lip and a complementary recessed portion in the remaining one-half portion of the circumference of said lip.

3. An insulated food container as claimed in claims 1 or 2 wherein each rib extends the height of the side wall.

4. An insulated food container as claimed in claims 1 or 2 wherein the height of each said hexagonally-shaped recess is approximately one-quarter inch with a recess diameter of three-eighths inch.

5. An insulated food container as claimed in claim 1 wherein the container is made of an expanded material.

6. An insulated food container as claimed in claim 5 wheren said container is made of polystyrene.

7. A polystyrene insulated hermetically-sealable, thin-walled food container for the storage and transport of food, comprising:

(a) an upper portion and a lower portion, said upper and said lower portions being identical, each said portion comprising:
(i) a thin-walled flat base surface,
(ii) thin outwardly-extending side walls, and
(iii) a circumferential lip around the top of said side walls;

(b) locking means adapted to releasably and hermetically lock said upper and said lower portions together, said locking means comprising a protrusion extending upwardly from the top surface of said lip about one-half the circumference of said lip and a complementary recessed portion in the remaining one-half portion of the circumference of said lip;

(c) a plurality of elongate wall members integral with and upstanding from the interior surface of said base surface, each of said plurality of wall members being integrally joined at each end thereof to two others of said wall members to define a regular pattern of hexagonally-shaped recesses upstanding from said base surface, except for said wall members immediately adjacent said side wall which are joined to each other at each end and form the outer perimeter of said regular pattern of recesses, and (d) a plurality of vertical elongate parallel ribs integral with and extending from the interior of each side wall to impart strength thereto, each rib extending the height of the side wall and downwardly into integral join with the integrally-joined ends of said perimeter-forming wall members adjacent said side walls.

* * * * *